US006840074B2

(12) United States Patent
Kamino et al.

(10) Patent No.: US 6,840,074 B2
(45) Date of Patent: Jan. 11, 2005

(54) PIPE AND HEAT EXCHANGER, PIPE MANUFACTURING DEVICE, AND PIPE MANUFACTURING METHOD

(75) Inventors: Tojo Kamino, 3-8-6, Kameura 4-chome, Ube-shi, Yamaguchi 755-0002 (JP); Masaji Nukuto, Osaka (JP)

(73) Assignee: Tojo Kamino, Yamaguchi (JP)

( * ) Notice: Subject to any disclaimer, the term of this patent is extended or adjusted under 35 U.S.C. 154(b) by 0 days.

(21) Appl. No.: 10/384,652

(22) Filed: Mar. 11, 2003

(65) Prior Publication Data

US 2003/0173070 A1 Sep. 18, 2003

Related U.S. Application Data

(63) Continuation-in-part of application No. 09/959,366, filed on Oct. 22, 2001, now abandoned.

(30) Foreign Application Priority Data

Apr. 21, 1999 (JP) ..... 11-113230

(51) Int. Cl.[7] ..... B21B 19/00

(52) U.S. Cl. ..... 72/95; 72/121; 72/370.19; 29/890.048

(58) Field of Search ..... 72/77, 78, 95, 72/96, 98, 100, 121, 370.19; 29/890.045, 890.046, 890.048, 890.053, 727

(56) References Cited

U.S. PATENT DOCUMENTS 3,486,357 A * 12/1969 Raisch ..... 72/77
3,998,082 A * 12/1976 Mueller ..... 72/77
4,624,122 A * 11/1986 Bridier ..... 72/70

FOREIGN PATENT DOCUMENTS

RU 2003405 * 11/1993 ..... 72/96

* cited by examiner

*Primary Examiner*—Ed Tolan
(74) *Attorney, Agent, or Firm*—Takeuchi & Takeuchi

(57) ABSTRACT

A cylindrical pipe which is excellent in heat transfer characteristic and has no accumulation of liquid, wherein a flat-shaped portion (2) along the pipe axis (L) is formed inside the cylindrical pipe (1) formed in corrugated shape. As a method for manufacturing said pipe, the present invention provides a pipe manufacturing method, wherein a thin-wall blank cylindrical pipe (P) is fed in increments of a prescribed distance, while being rotated at a definite speed, a roller die (85) being pressed against the outer periphery of the cylindrical pipe, the roller die being advanced and retracted in accordance with the feed of the cylindrical pipe, for forming a spiral corrugation such that the groove depth thereof is gradually increased, starting from the flat portion of the cylindrical pipe, and reaches a maximum in the portion opposed to the flat one.

3 Claims, 14 Drawing Sheets

PIPE AND HEAT EXCHANGER, PIPE MANUFACTURING DEVICE, AND PIPE MANUFACTURING METHOD

CROSS REFERENCE TO RELATED APPLICATIONS

This is a continuation-in-part application of application Ser. No. 09/959,366, filed Oct. 22, 2001, now abandoned, which is a national stage filing under 35 U.S.C. 371 of international application number PCT/JP00/02504, filed Apr. 18, 2000.

FIELD OF THE INVENTION

The present invention relates to a pipe and a heat exchanger, a pipe manufacturing device, and a pipe manufacturing method.

BACKGROUND

With a certain type of conventional heat exchangers using a cylindrical pipe as a heat transfer pipe, the cylindrical pipe is formed in corrugated shape for improving the heat transfer characteristic (heat transfer efficiency). When such a heat exchanger is used in the food, bio-technological, and electronics industries and the like, it must meet the requirements that the intraductal liquid be able to be thoroughly discharged to the outside, and that the cleanability be improved and the level of sanitation be enhanced.

Especially, horizontal heat exchangers using a pipe formed in corrugated shape, however, have a drawback of that liquid accumulation is produced in the root of the corrugation, which makes it difficult to thoroughly discharge the residual liquid to the outside in draining or cleaning. Especially, for the processes for manufacturing pharmaceuticals, those in the electronics industry that use a cleaning liquid or pure water, the variety of processes in the bio-technological and food industries, and the like, the heat exchanger used must produce no residual liquid, thus, a satisfactory measure has been demanded.

SUMMARY OF THE INVENTION

Then, the purpose of the present invention is to provide a cylindrical pipe which has an excellent heat transfer characteristic and produces no liquid accumulation, as well as a heat exchanger which uses such a cylindrical pipe; a pipe manufacturing device; and a pipe manufacturing method.

To achieve the above purpose, the pipe according to the present invention is a pipe, wherein a spiral corrugation is formed by applying a pressure to a thin-wall blank cylindrical pipe from the outside for creating a groove, the corrugation being formed such that the groove depth thereof is gradually increased, starting from the flat portion of the cylindrical pipe, and reaches a maximum in the portion opposed to the flat one. Further, such a pipe is used as a heat transfer pipe, and the heat transfer pipe is disposed such that the flat portion thereof provides the pipe bottom.

If a cylindrical pipe which is formed in corrugated shape is used as a heat transfer pipe for a heat exchanger, the formation of a turbulence is promoted inside it, which results in the heat transfer efficiency being improved. Further, by disposing the flat portion formed along the pipe axis in the corrugated cylindrical pipe such that it provides the pipe bottom, the residual liquid can be thoroughly removed in draining the liquid inside the pipe or in cleaning the pipe inside, the possibility of contamination being eliminated with the level of sanitation being raised, and the efficiency of blowing off the intraductal liquid with the use of compressed gas being improved. Therefore, the heat exchanger according to the present invention is well suited for the pharmaceutical industry, electronics industry, bio-technological industry, food industry, and the like where no contamination of impurity is permitted.

As a method for manufacturing said pipe, the present invention provides a pipe manufacturing method, wherein a thin-wall blank cylindrical pipe is fed in increments of a prescribed distance, while being rotated at a definite speed, a roller die being pressed against the outer periphery of the cylindrical pipe, the roller die being advanced and retracted in accordance with the feed of the cylindrical pipe, for forming a spiral corrugation such that the groove depth thereof is gradually increased, starting from the flat portion of the cylindrical pipe, and reaches a maximum in the portion opposed to the flat one.

As a pipe manufacturing device, the present invention provides a pipe manufacturing device, comprising a working section which allows rotatably and slidably inserting a thin-wall blank cylindrical pipe which is to be fed in the direction of the axis of the pipe in increments of a prescribed distance, while being rotated at a definite speed; and a roller feeding section in which a roller die is supported so as to face the outer periphery of the cylindrical pipe through the insertion opening provided in the working section, and the roller die is advanced and retracted in accordance with the feed of the cylindrical pipe, for forming a spiral corrugation such that the groove depth thereof is gradually increased, starting from the flat portion of the cylindrical pipe, and reaches a maximum in the portion opposed to the flat one.

Further, the present invention provides the pipe manufacturing device as described in the just above paragraph, wherein said working section has a housing and a bearing incorporated in the housing, said bearing being made of a self-lubricating material, having a slide way therein to rotatably hold the cylindrical pipe, and a tapered outer periphery, being held in the housing such that the bearing is capable of being moved in the direction of the axis of the cylindrical pipe for adjustment, and allowing the cylindrical pipe to be held with no clearance by moving the bearing for adjustment and fixing it.

Further, the present invention provides a pipe manufacturing device, comprising a main feeding section, a power relaying section, a working section, and a roller feeding section, said main feeding section comprising a chuck which chucks one end of a thin-wall blank cylindrical pipe, and a main feeding shaft which is straight moved at a definite speed, having the chuck at the nose thereof, said power relaying section being provided in parallel with the main feeding shaft in said main feeding section, comprising a power relaying shaft which is capable of being straight moved at the same speed as the main feeding shaft, and a power transmission section which transmits rotating power from the power relaying shaft to said main feeding section, said working section being configured so as to allow rotatably and slidably inserting a thin-wall blank cylindrical pipe which is to be fed in the direction of the axis of the pipe in increments of a prescribed distance while being rotated at a definite speed; and said roller feeding section being configured such that a roller die is supported so as to face the outer periphery of the cylindrical pipe through the insertion opening provided in the working section, and the roller die is advanced and retracted in accordance with the feed of the cylindrical pipe.

DESCRIPTION OF THE PREFERRED EMBODIMENTS

Hereinbelow, the present invention will be specifically described with reference to the drawings showing embodiments thereof.

Figure 1:
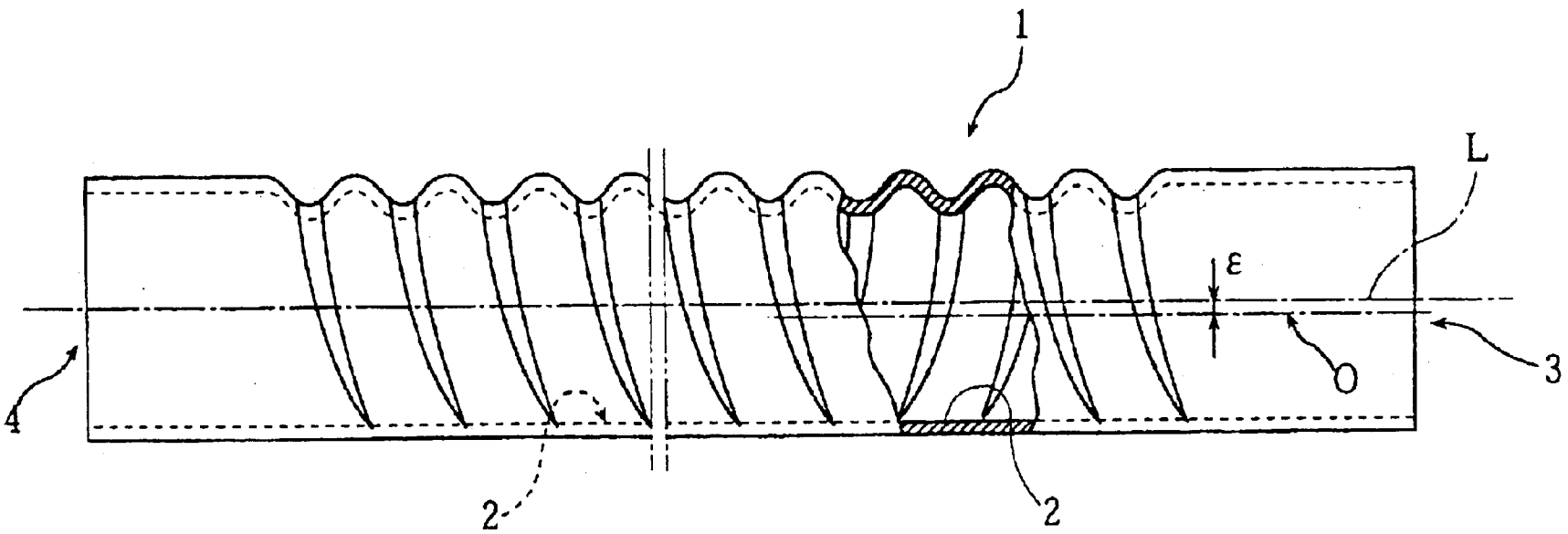
FIG. 1 is a side view, with a portion broken away for clarity, showing an embodiment of the present invention.
Figure 2:
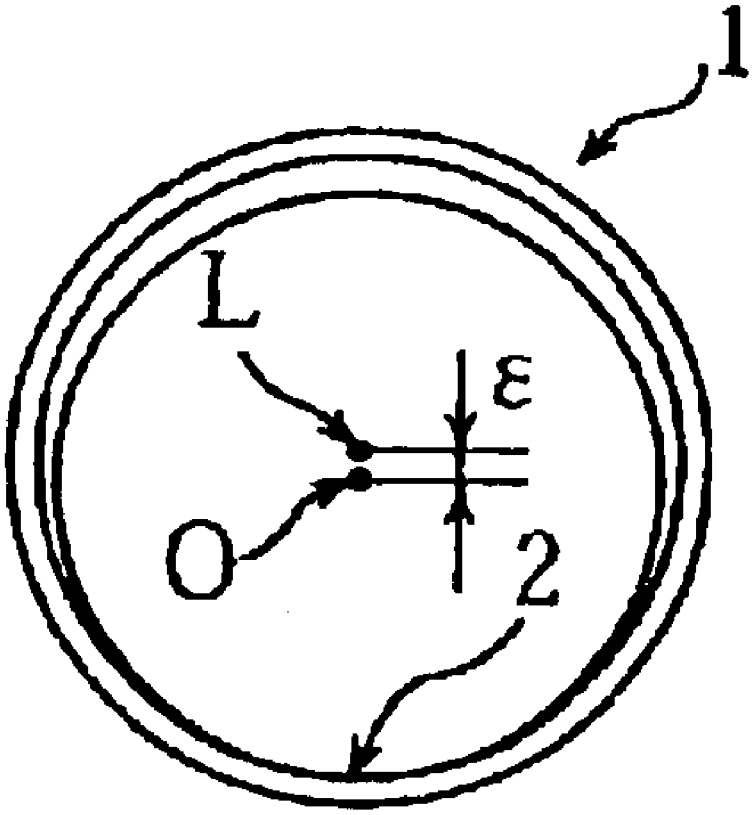
FIG. 2 is a cross-sectional view thereof.

FIG. 1 is a side view, with a portion broken away for clarity, of a cylindrical pipe 1 according to the present invention, and FIG. 2 is a cross-sectional view thereof. This cylindrical pipe 1 is formed in spirally corrugated shape, however, the center of the spiral (the axis) "O" is offset by a dimension of $\epsilon$ with respect to the pipe axis L as shown in FIG. 2, the cross sectional view. Thus, inside the cylindrical pipe 1, a flat portion 2 extending linearly along the pipe axis L is formed. Therefore, when the cylindrical pipe 1 is disposed such that the flat portion 2 provides the pipe bottom, the liquid inside the pipe can be thoroughly discharged from the pipe opening 3, 4 to the outside with no liquid accumulation being produced in the inside. Such cylindrical pipe is well suited for use as a heat transfer pipe for a shell-and-tube heat exchanger 5 (as shown in FIG. 3).

In other words, the inside diameter (root diameter) of the corrugation of the above-mentioned cylindrical pipe 1 is offset by a small dimension of E below the pipe axis L, as shown in FIG. 2, with the pipe being formed such that a flat portion 2 in the shape of a linear strip, which is free from corrugation, is provided along the pipe axis L (see FIG. 1). The degree of corrugation is gradually lowered (the depth of the corrugation is gradually decreased) as the pipe bottom is approached from the pipe top through either pipe side, and in the flat portion 2, no corrugation is given (the depth of the corrugation is zero).

Figure 3:
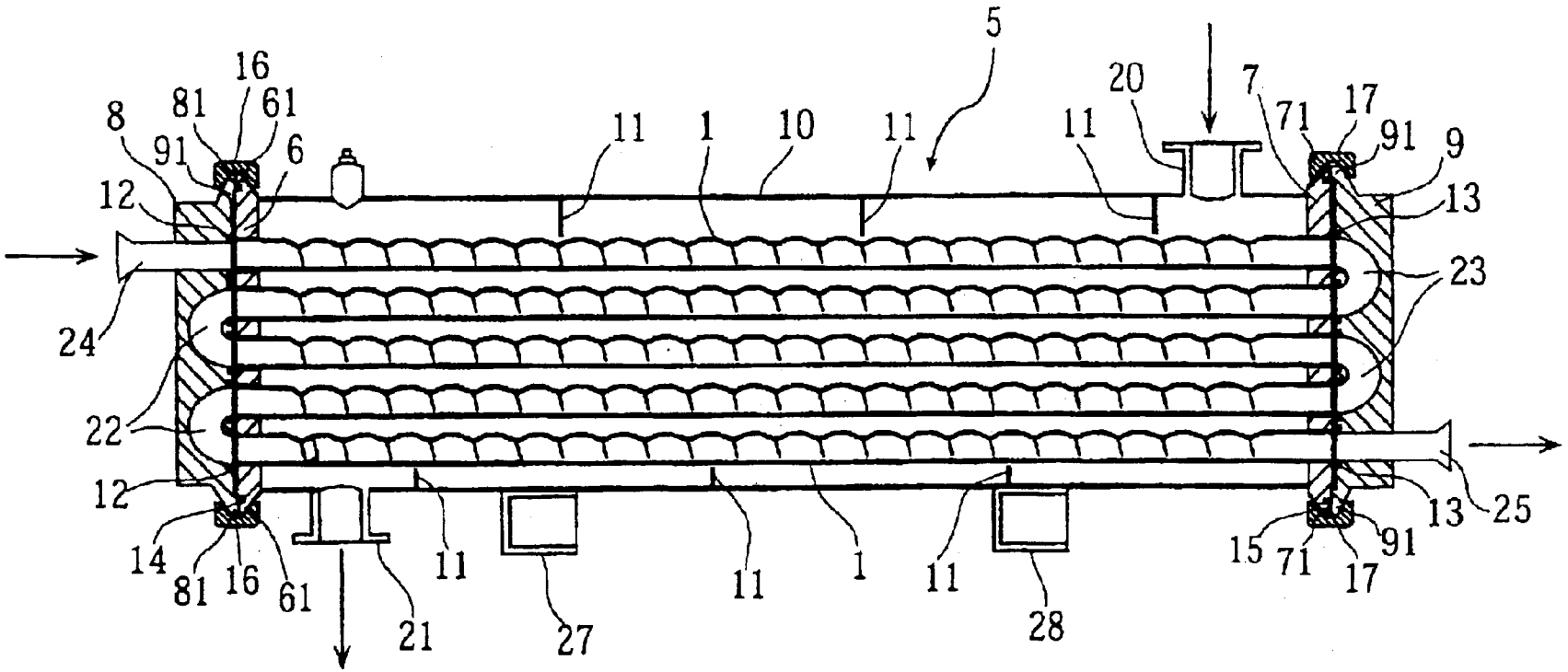
FIG. 3 is a sectional view of a shell-and-tube heat exchanger.
Figure 4A:
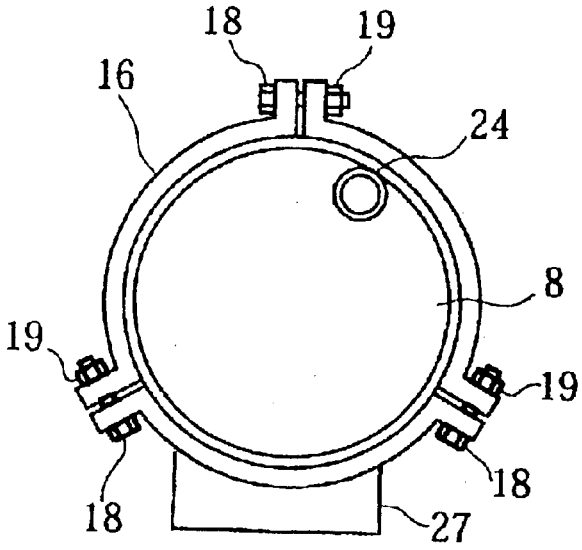
FIG. 4(A) is a left side view thereof.
Figure 4B:
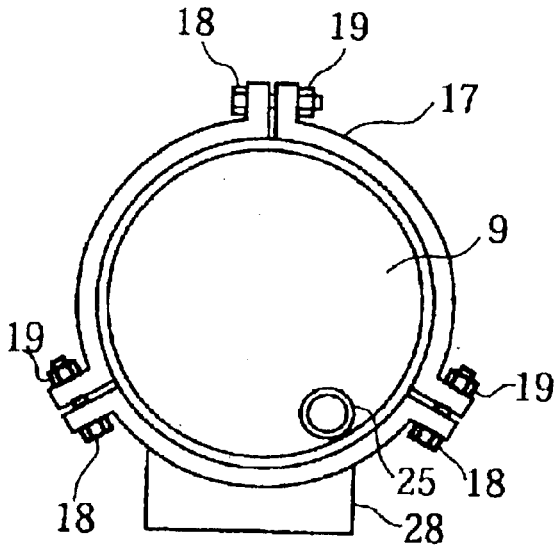
FIG. 4(B) is a right side view thereof.
Figure 5A:
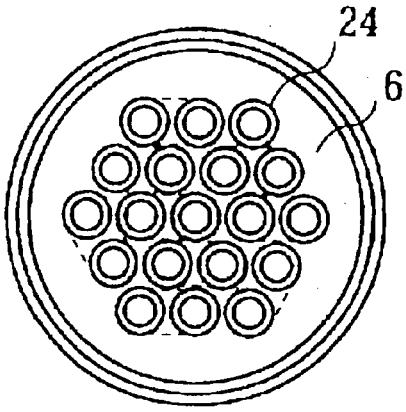
FIG. 5(A) is a side view of a left pipe plate.
Figure 5B:
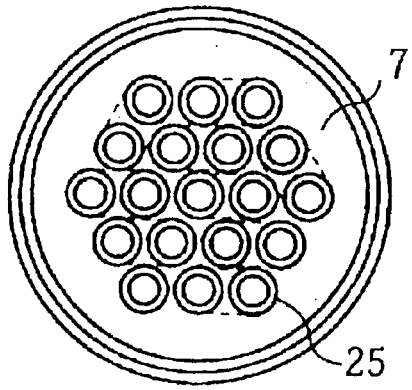
FIG. 5(B) is that of a right pipe plate.
Figure 6:
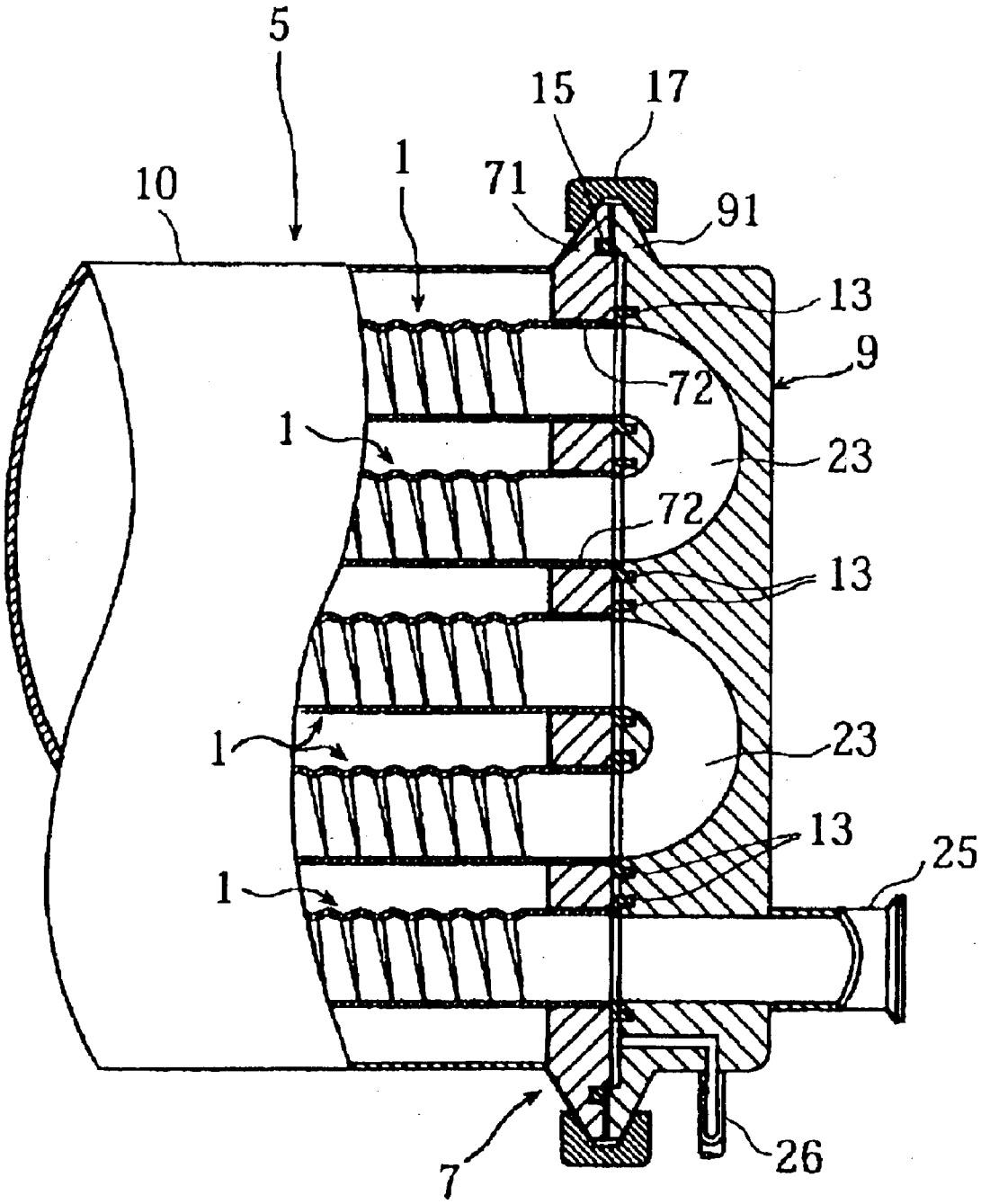
FIG. 6 is a sectional view of the right end portion of a shell-and-tube heat exchanger.

FIG. 3 is a sectional view of a shell-and-tube heat exchanger 5 of mono-tube type which adopts the cylindrical pipe 1 as shown in FIG. 1 and FIG. 2 as the heat transfer pipe; FIG. 4(A) is a left side view thereof, and FIG. 4(B) is a right side view thereof; FIG. 5(A) is a left side view of one pipe plate 6, and FIG. 5(B) is a right side view of the other pipe plate 7; FIG. 6 is a sectional view of the right end portion.

Here is a description of the main components of the shell-and-tube heat exchanger 5; 10 indicates a jacket pipe; 8, 9 a cover plate; 11 a baffle; 12, 13 a special ring-shaped gasket provided around the heat transfer pipe 1; 14, 15 a ring-shaped gasket for the circumferential portion of the cover plate; 16, 17 a clamp band for jointing one pipe plate 6 with the cover plate 8, and the other pipe plate 7 with the cover plate 9, respectively; and 18, 19 a bolt and nuts for clamping the clamp band 16, 17.

The jacket pipe 10 is of cylindrical, horizontal stationary type, being made of a corrosion resistant metallic material, such as stainless steel. Inside thereof, a plurality of heat transfer pipes 1 are disposed in parallel, a process liquid which heat is to be exchanged being let to flow into the heat transfer pipe 1, and at both ends of the jacket pipe 10, an inlet pipe 20 and an outlet pipe 21 for a heating medium (liquid) are mounted, the heating medium being let to flow from one baffle 11 to another provided in the jacket pipe 10, and thus it flowing in a turbulent condition assuring efficient contact with the surface of the heat transfer pipe 1.

The heat transfer pipes 1 are made of a corrosion resistant metallic material, such as stainless steel and a titanium material, being disposed in parallel and fixed by means of the pipe plate 6, 7 together with the jacket pipe 10, and each heat transfer pipe 1 is connected to a U-turn flow path 22, 23 in the cover plate 8, 9, respectively, forming a forward or backward feeding heat transfer pipe. As described above, the heat transfer pipes are formed in corrugated shape for producing a turbulence in the process liquid flowing in the pipe, and thus increasing the overall heat transfer coefficient, which provides a measure of the performance of a heat exchanger.

Between the pipe plate 6, 7, which supports the heat transfer pipes 1, and the cover plate 8, 9 (see FIG. 6), a special ring-shaped gasket 12, 13 and a ring-shaped gasket 14, 15 are installed, and the flange edges 61 and 81, and 71 and 91, which are formed in tapered shape in the circumferential portions of the pipe plate 6, 7, and the cover plate 8, 9, respectively, are fixed by means of the clamp band, 16, 17, which is tightened with the use of the bolt and nuts 18, 19, such that the jointing surfaces are uniformly and tightly contacted with each other.

The special ring-shaped gasket 12, 13 is formed in ring shape which is roughly L-shaped in cross section, being provided for sealing the heat transfer pipe 1. Specifically, as shown in FIG. 6, the right end portion of the shell-and-tube heat exchanger is configured such that the convex of the special ring-shaped gasket 13 is tightly fit into the concave formed in the inlet/outlet surface for the U-turn flow path 23 which is provided in the cover plate 9, therefore, the cover plate 9 (or 8) can be opened and closed for easily performing inspection/cleaning of each process flow path without the special ring-shaped gasket 13 dropping out.

In addition, because the bore of the special ring-shaped gasket 13 is provided with the same diameter as that of the bore of the heat transfer pipe 1, which is inserted into the pipe hole 72 in the pipe plate 7, both bores are jointed with each other with no step being formed in the junction, thus no accumulation of the process liquid is produced at the jointing surfaces of the pipe plate 7 and the cover plate 9, although they are flat. The left end portion of the shell-and-tube heat exchanger is configured in the same manner as the right end portion.

The ring-shaped gasket 14, 15 provided between the circumferential portions of the pipe plate 6 and the cover plate 8, and between those of the pipe plate 7 and the cover plate 9, respectively, causes the process liquid (if leaked from a particular special ring-shaped gasket 12, 13) to be discharged to the outside only through a drain/leak detection pipe 26 (shown only for the right end portion) provided in the cover plate 8, 9, thus permitting the proper operation control even to be performed during the running of the shell-and-tube heat exchanger.

With such a configuration, the process liquid is fed in at the inlet pipe 24 as shown in FIG. 3, and while it is fed forward or backward through the respective heat transfer pipes 1, which are connected to one another by means of the U-turn flow path 22, 23, heat exchange is performed at a high heat transfer efficiency between it and the heating medium in the jacket pipe 10 (outside the heat transfer pipe 1), with the formation of a turbulence being promoted; finally the process liquid is discharged through the outlet pipe 25 at the cover plate 9. The flat portion 2, which is linearly formed along the pipe axis L in the heat transfer pipe 1, is disposed such that it provides the pipe bottom, thus, when the liquid inside the pipe is to be drained after the completion of the heat exchange operation, or when the heat exchanger is to be cleaned, the residual liquid inside the pipe can be thoroughly removed by gravitational drain or forced drain with the use of compressed gas, resulting in the possibility of the so-called intraductal contamination being eliminated, and the level of sanitation being raised. Also, the safety in the subsequent process can be improved. Therefore, the heat exchanger according to the present invention is well suited for food processing, bio-technology processes, manufacture of pharmaceuticals, and production processes, such as cleaning of electronic parts, where no contamination due to even a trace of impurity is permitted, and thus heating, cooling, sterilization, and cleaning are repetitively performed, a high level of sanitation being often required.

The present invention will not specify the geometry of corrugation of the cylindrical pipe 1; the geometry may be changed as required, and thus being not limited to the spiral corrugation as shown in FIG. 1, may be of a single and continuous wave (single wave) (which illustration omitted), and so long as the flat portion 2 extending along the pipe axis L at the pipe bottom is formed in the shape of a strip, for example, the center of the corrugation may not always be offset as shown in FIG. 2, the mode of the design being optional.

Figure 7:
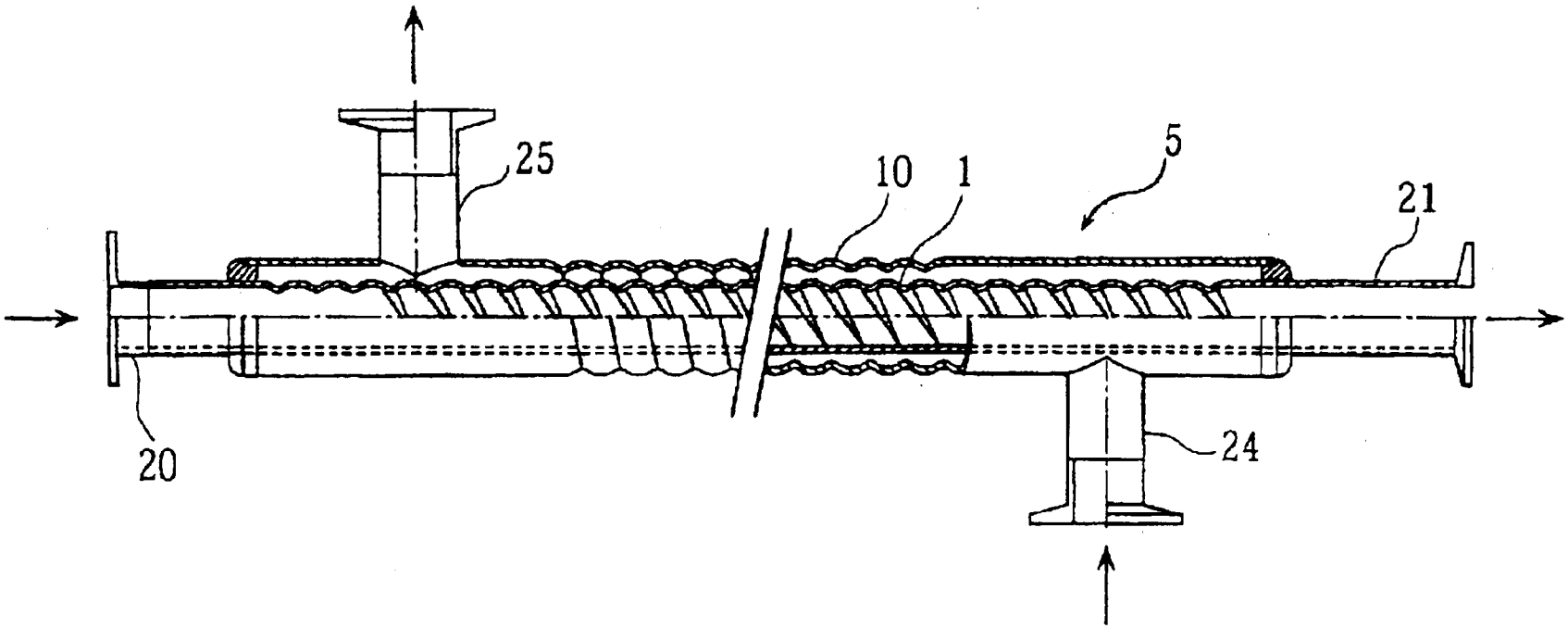
FIG. 7 is a front view, with critical portions broken away for clarity, of a double-tube heat exchanger.

FIG. 7 shows a double-tube heat exchanger 5; 1 indicating a heat transfer pipe 1; 10 a jacket pipe; 20 a process liquid inlet pipe; 21 a process liquid outlet pipe; 24 a heating medium inlet pipe; and 25 a heating medium outlet pipe. With this double-tube heat exchanger 5, the heating medium and the process liquid are let to flow in a countercurrent flow such that they face to each other, resulting in an increased overall heat transfer coefficient, and in many applications, a few (a plurality of) double-tube heat exchangers 5 are connected to one another with a U-shaped pipe (not shown) to form a single process flow path. Both the heat transfer pipe 1 and the jacket pipe 10 in this double-tube heat exchangers 5 are formed to provide a corrugation such that a turbulence is created in both the heating medium and the process liquid, resulting in the heat transfer efficiency being improved.

If a few double-tube heat exchangers 5 are combined into a single processing unit, being disposed at different levels with an upper heat exchanger being connected to a lower one by means of a U-shaped pipe to form a step-like process flow path, for example, (which illustration omitted), the process liquid, the cleaning drainage, or the like can be thoroughly discharged to the outside by gravitational drain from the bottom heat exchanger, which makes it possible to effectively prevent contamination due to liquid accumulation from being caused. Therefore, this system can be used with a highly viscous liquid, a slurry liquid, and the like, and further it allows a residual liquid, such as a pig, to be recovered, and the level of sanitation for the entire unit to be raised.

Figure 8:
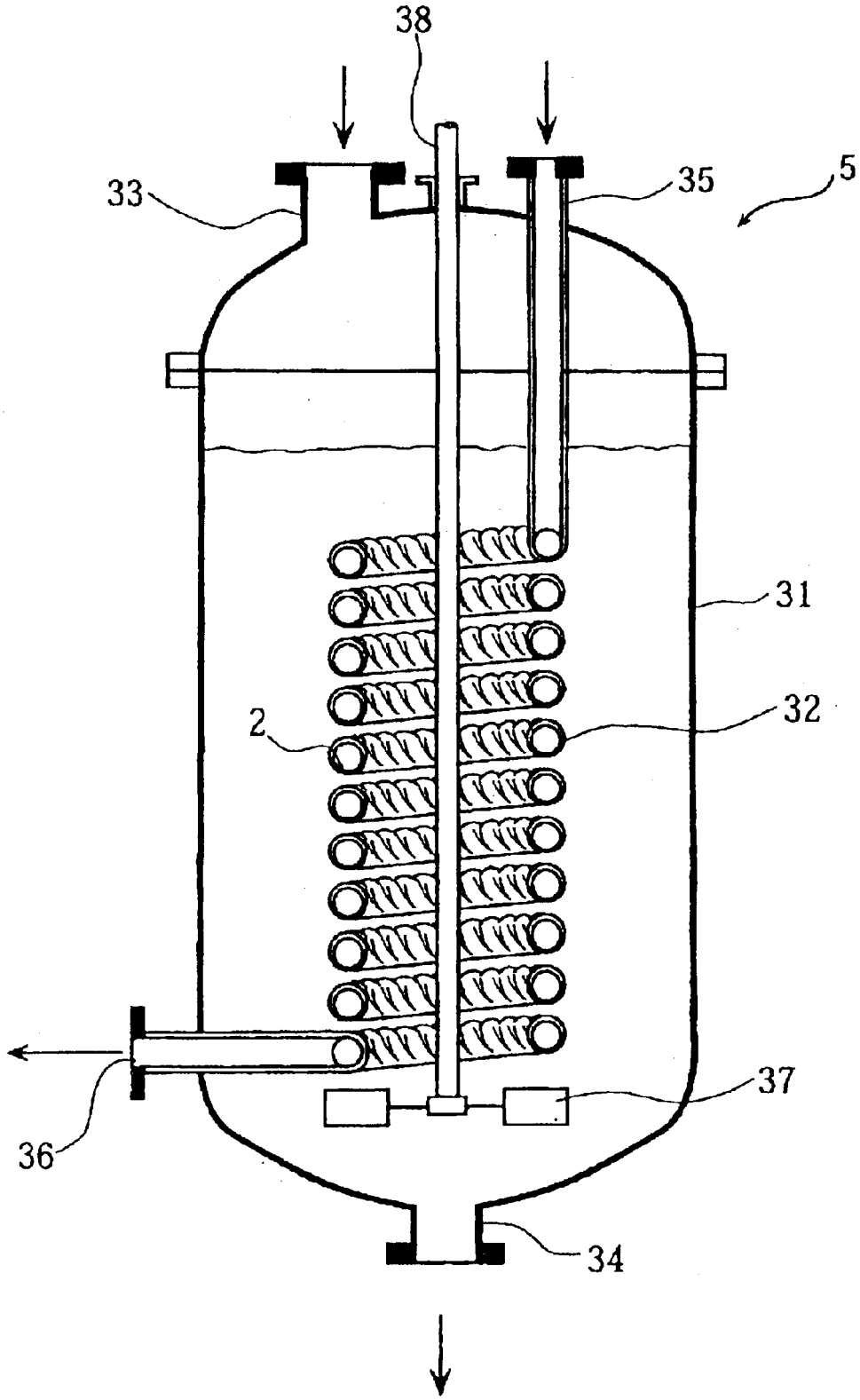
FIG. 8 is a front view, with critical portions broken away for clarity, of a coil-type heat exchanger.
Figure 9:
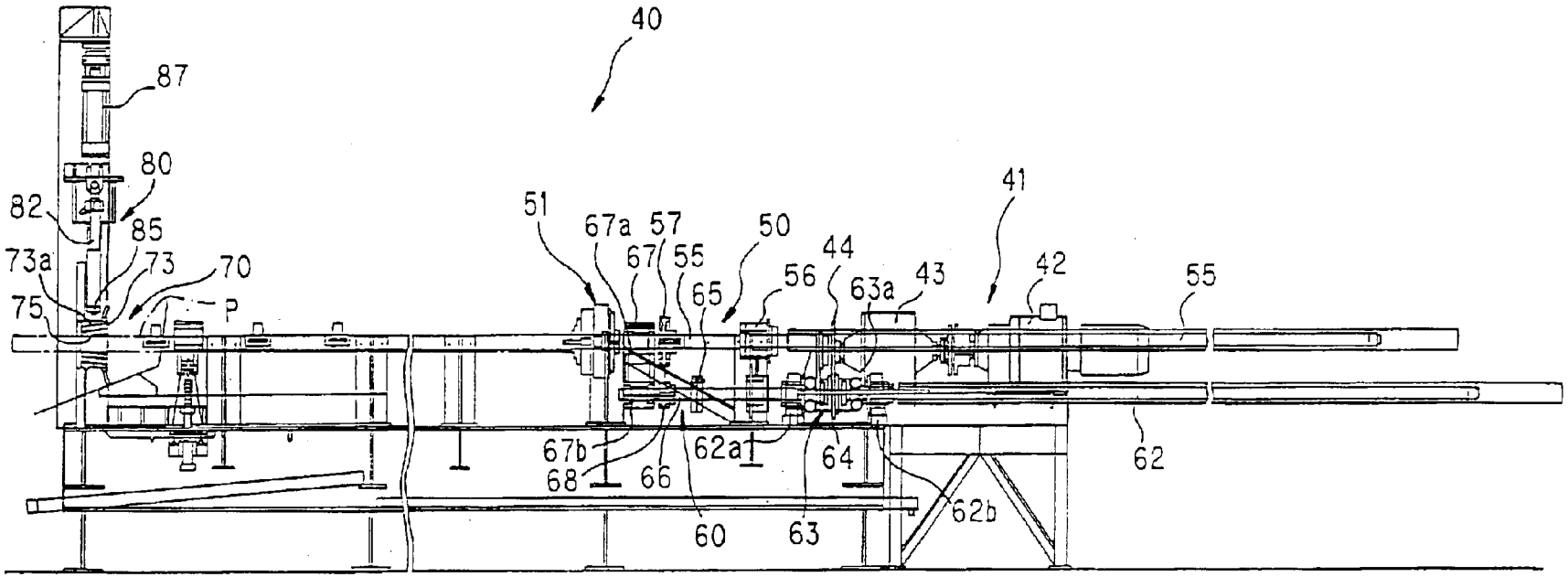
FIG. 9 is a side view of a pipe manufacturing device of an embodiment of the present invention.
Figure 10:
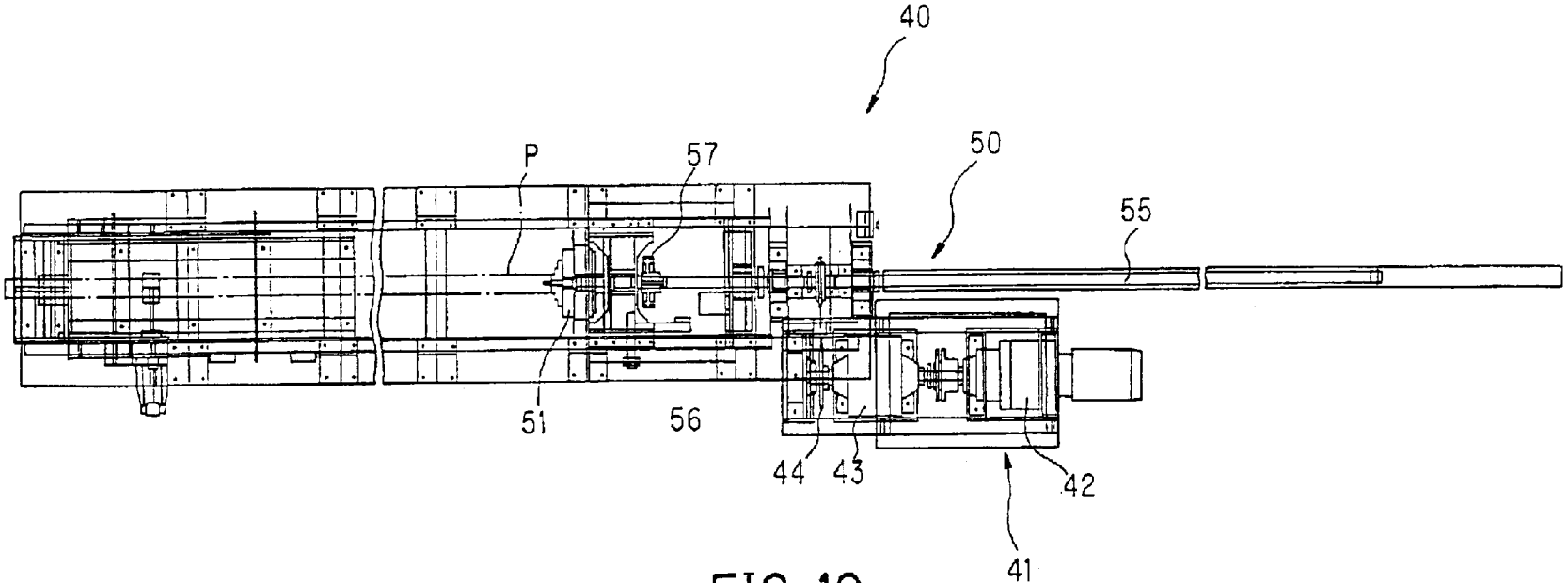
FIG. 10 is a bottom view of the same device.

FIG. 8 shows a coil-type heat exchanger 5. With it, a spirally formed cylindrical pipe is adopted as a heat transfer coil 32. 31 indicates a vessel; 33 a heating medium inlet pipe; 34 a heating medium outlet pipe; 35 a liquid inlet pipe; 36 a liquid outlet pipe; 37 a stirring vane; and 38 a rotation shaft for the stirring vane 37. With this configuration, the reaction liquid or the process liquid is introduced into the vessel 31 at the liquid inlet pipe 35, and then is stirred by the stirring vane 37. On the other hand, the heating medium is fed into the heat transfer coil 32 at the heating medium inlet pipe 33 at the top, and is discharged at the heating medium outlet pipe 34 at the bottom, meanwhile, heat exchange is performed between the heating medium and the process liquid at the outside surface of the heat transfer coil 32.

With such a coil-type heat exchanger 5, it is well known that, if a corrugation is formed on the surface of the heat transfer coil 32, the heat transfer efficiency is improved in heat exchange, however, in the prior art, when draining the heating medium, or when draining the liquid for cleaning the inside of the heat transfer coil 32, such a liquid is sometimes left at the bottom of the heat transfer coil 32 which is formed in corrugated shape, resulting in the heat transfer efficiency being lowered due to the intraductal contamination, and the heat transfer coil 32 being corroded. Then, with the present invention, a flat potion 2, which is free from corrugation, is continuously formed along the (spiral) pipe axis at the bottom of the heat transfer coil 32, which eliminates the occurrence of liquid accumulation, and thus allows the liquid inside the pipe to be thoroughly discharged to the outside by gravitational drain. Thus, the maintenance can be fully performed, which permits a high heat transfer efficiency to be always obtained, and the durability to be improved.

FIG. 9 to FIG. 15 show a pipe manufacturing device 40 according to one embodiment of the present invention, and the pipe manufacturing device 40 comprises a power section 41, a main feeding section 50, a power relaying section 60, a working section 70, and a roller feeding section 80.

The power section 41 comprises a drive motor 42, a speed reducer 43, and an output sprocket 44.

The main feeding section 50 comprises a chuck 51 which chucks the rear end of a thin-wall blank cylindrical pipe, and a main feeding shaft 55 which is straight moved at a definite speed, having the chuck 51 at the nose thereof. The main feeding shaft 55 is a bolt shaft which is engaged with a nut member 56 fixed on the frame.

The power relaying section 60 is provided in parallel with the main feeding shaft 55 in the main feeding section 50, the main component thereof being a power relaying shaft 62 which can be straight moved at the same speed as the main feeding shaft 55, and the power relaying shaft 62 being a square shaft which is rotatably supported by bearings 62*a*, 62*b*, with a power receiving section 63 being provided between the bearings 62*a*, 62*b*. The power receiving section 63 is fit to the power relaying shaft 62 through rollers 63*a*, 63*a*, . . . such that the power relaying shaft 62 can be slid in the axial direction, and the power receiving section 63 can be rotated integrally with the power relaying shaft 62.

In the power receiving section 63, a sprocket 64 is provided, being connected to the output sprocket 44 in the power section 41 through a chain.

To the nose of the power relaying shaft 62 in the power relaying section 60, a round shaft 66 is connected through a joint 65, and the nose of the main feeding shaft 55 in the main feeding section 50 and the round shaft 66 in the power relaying section 60 are connected to each other through a connecting member 67 having bearings 67*a*, 67*b*, which rotatably fit to the nose of the main feeding shaft 55 and the round shaft 66, respectively.

The nose of the main feeding shaft 55 and the round shaft 66 are provided with a sprocket 57, 68, respectively, in a location adjacent to the connecting member 67, the sprockets 57, 68 being connected to each other by a chain.

Thus, the main feeding shaft 55 in the main feeding section 50 and the power relaying shaft 62 in the power relaying section 60 are connected to each other such that they can be advanced and retracted, and rotated in synchronization.

The working section 70 is configured so as to allow rotatably and slidably inserting a thin-wall cylindrical pipe P which is to be fed in increments of a definite distance in the axial direction, while being rotated at a definite speed.

Figure 14:
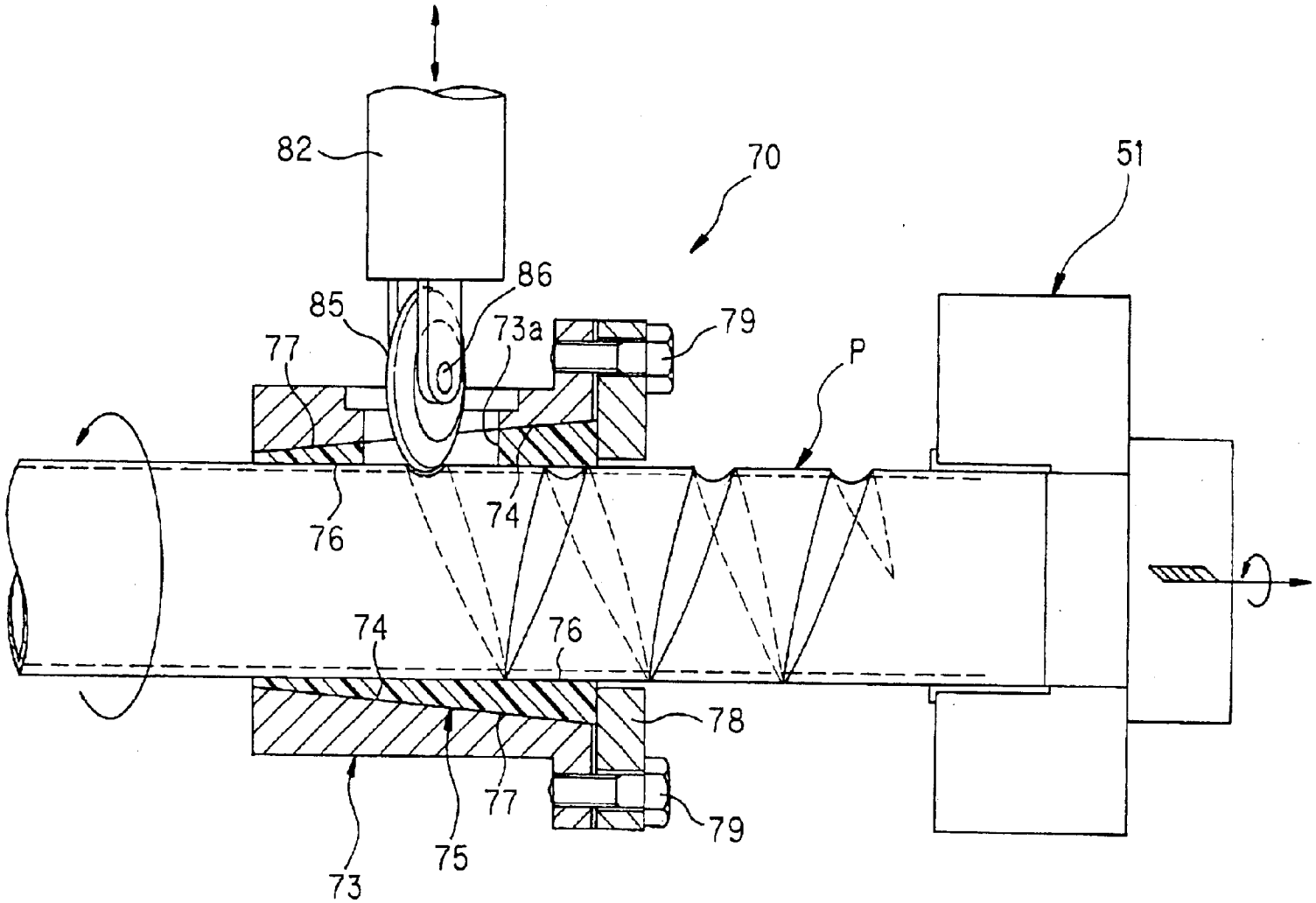
FIG. 14 is a detailed enlarged side view of the critical portion of the same device.

FIG. 14 is a detailed drawing of the working section 70.

The working section 70 has a housing 73, and a bearing 75 incorporated in the housing 73.

The bearing 75 is made of such a self lubricating material as nylon plastic, having a slide way 76 therein to rotatably hold the cylindrical pipe P, and a tapered outer periphery 77, being held in the housing 73 such that the bearing can be moved in the direction of the axis of the cylindrical pipe P for adjustment, and allowing the cylindrical pipe P to be held with no clearance by moving the bearing 75 for adjustment and fixing it.

In other words, the bearing 75 is fit into a tapered holding bore 74 in the housing 73, a holding ring 78 being pressed against one end of the bearing 75 from the larger diameter side of the holding bore 74, and is fixed, being forced into the holding bore 74 with bolts 79, 79. Tightening the bolts 79, 79 will force the bearing 75 in to fit it to the outside diameter of the thin-wall cylindrical pipe P for holding it without clearance.

A roller die 85 is supported by a support shaft 86 such that it faces the outer periphery of the cylindrical pipe P through an insertion opening 73*a* provided in the housing 73 in the working section 70.

Figure 11:
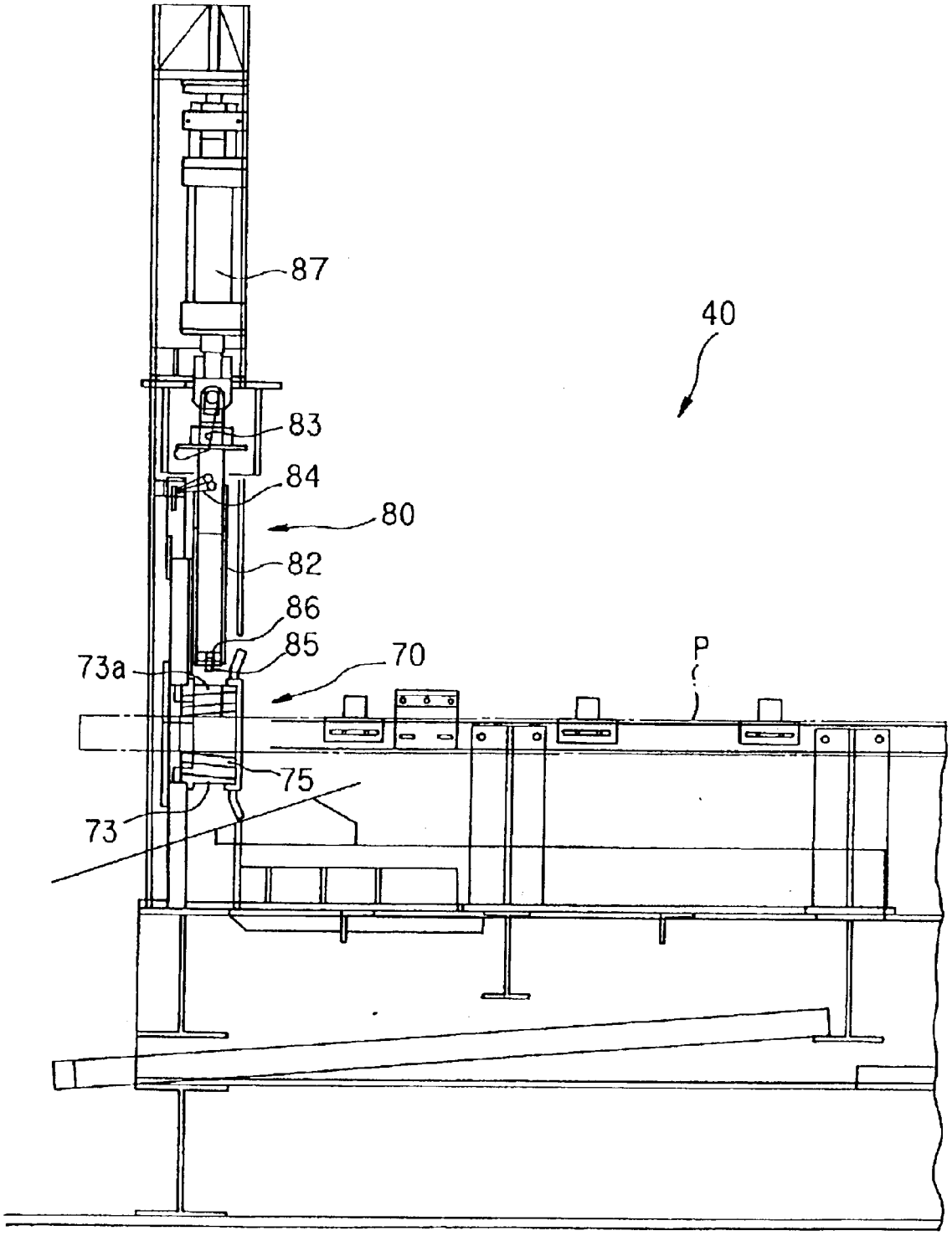
FIG. 11 is a side view of the critical portion of the same device.
Figure 12:
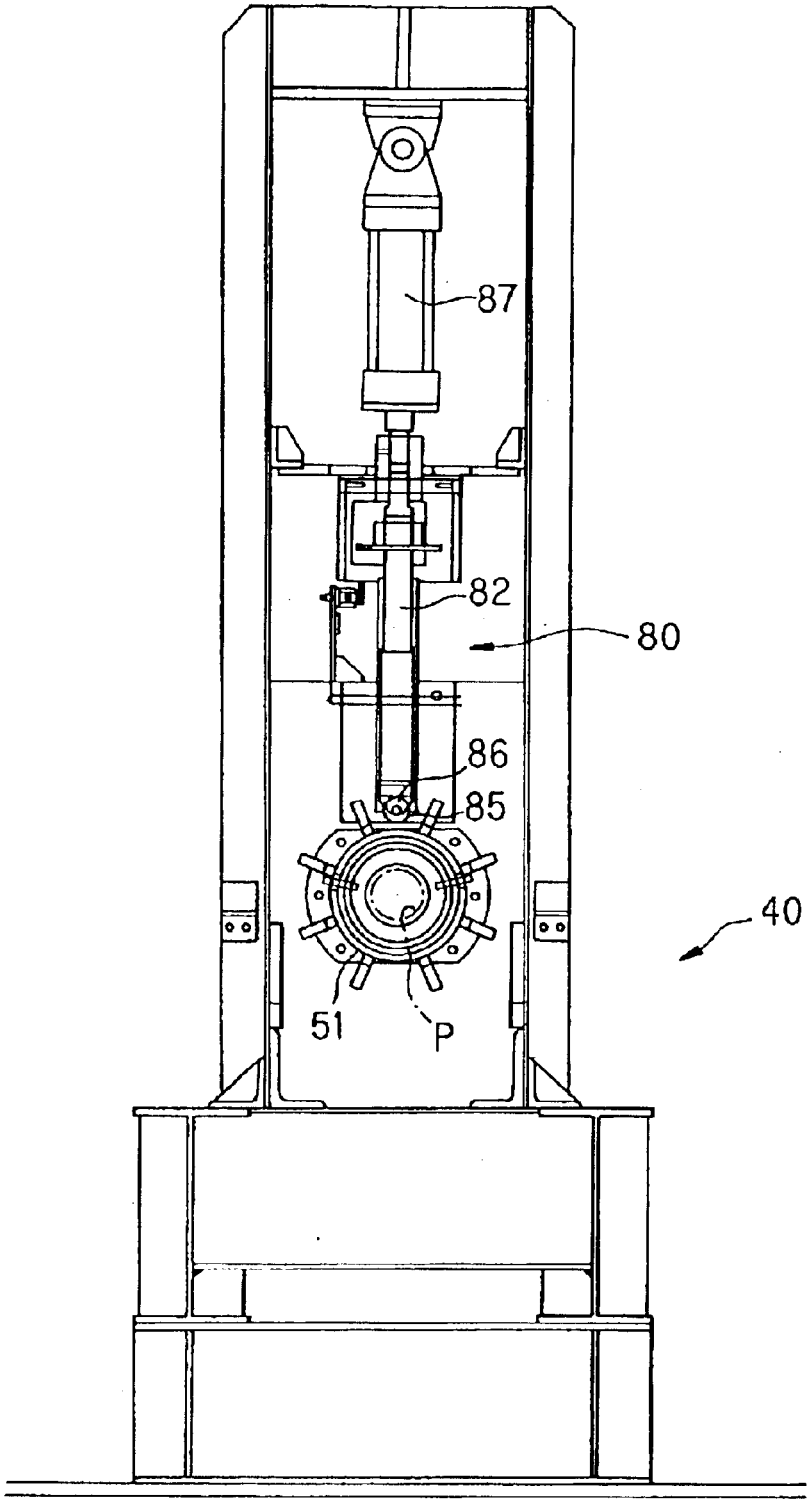
FIG. 12 is a front view of the same device.
Figure 13:
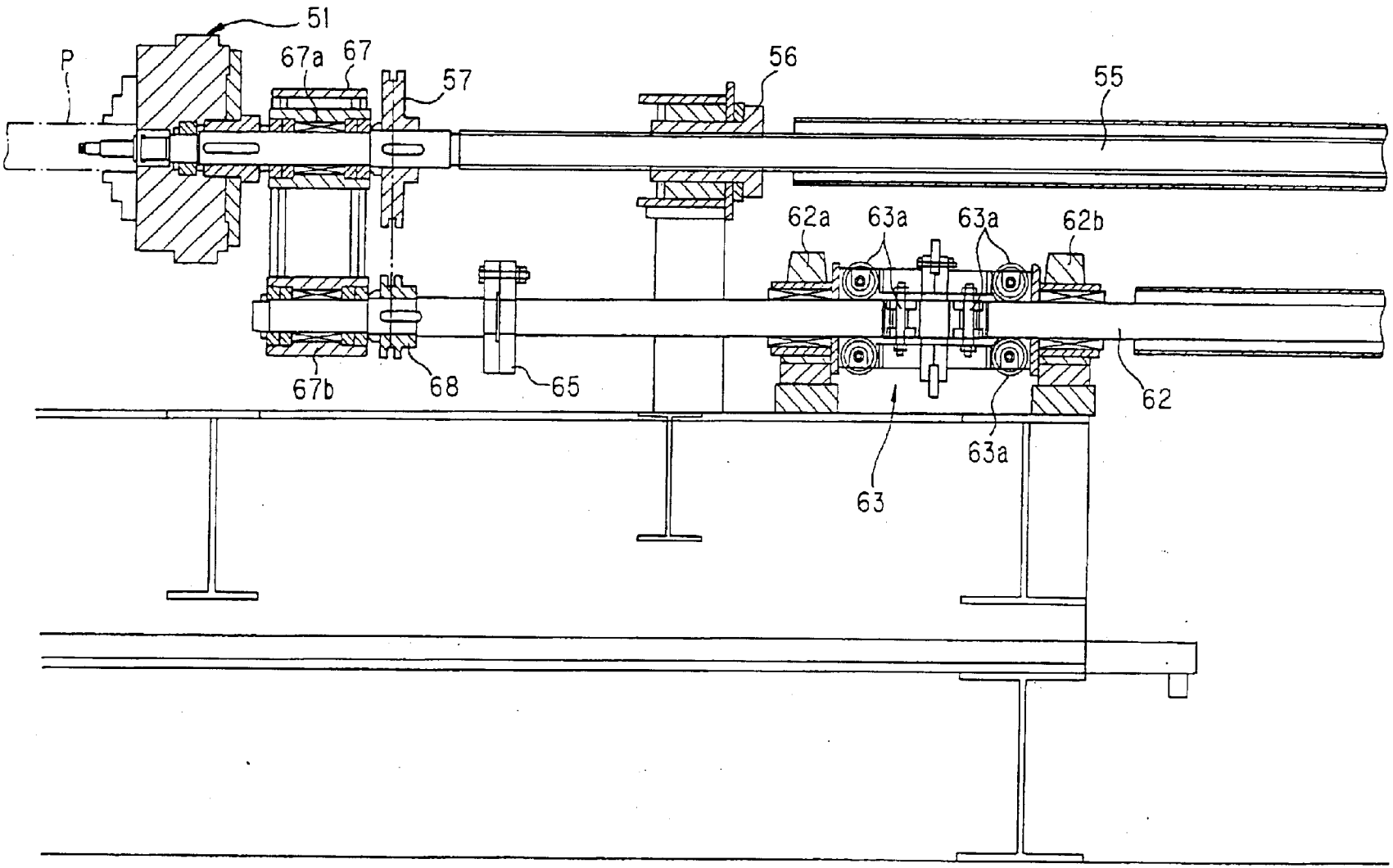
FIG. 13 is an enlarged side view of the critical portion of the same device.
Figure 15:
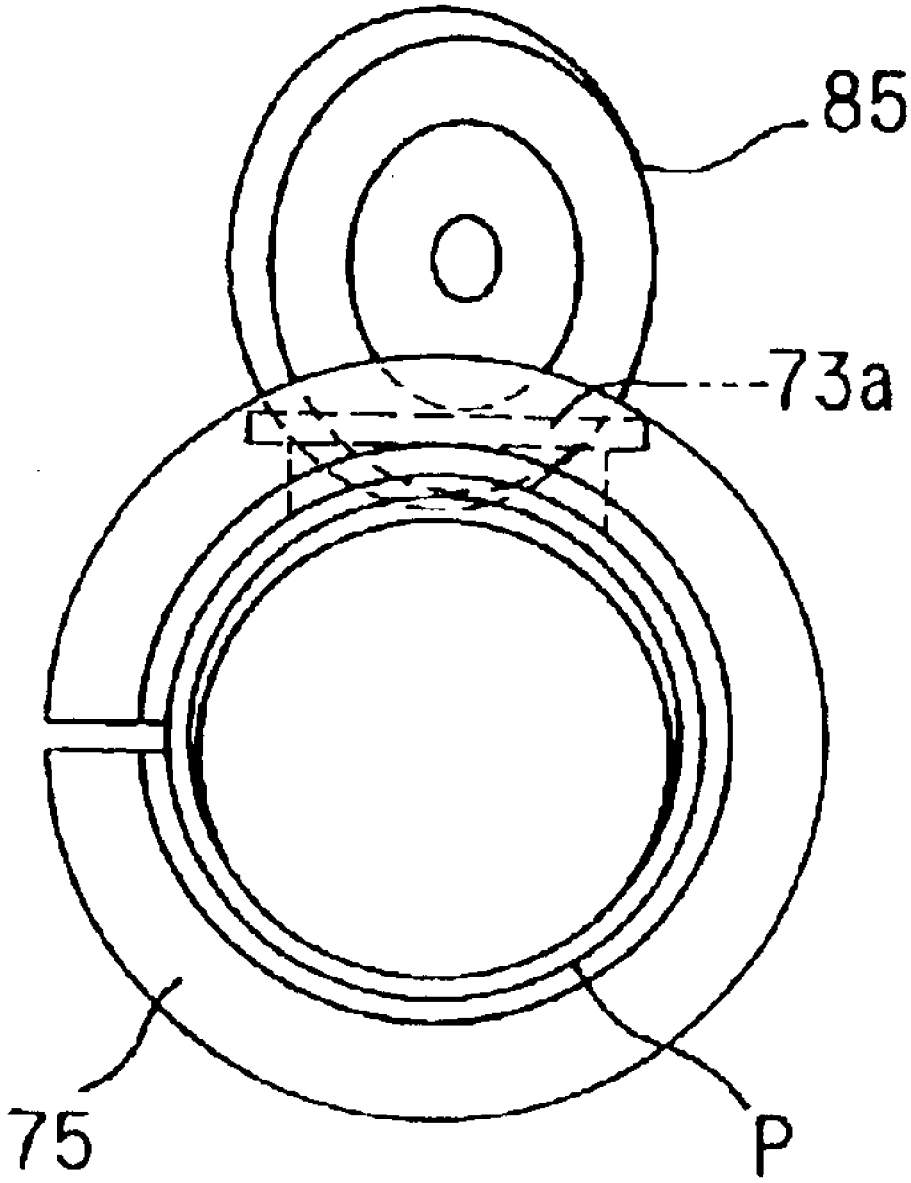
FIG. 15 is a detailed enlarged side view of the critical portion of the same device.

As shown in FIG. 11 and FIG. 12, the roller feeding section 80 is configured such that the roller die 85 is advanced and retracted in accordance with the feed of the cylindrical pipe P. The roller die 85 is contacted with the cylindrical pipe P and pressed against it at a prescribed angle with respect to it as shown in FIG. 15.

In the roller feeding section 80, an intermediate member 82 is connected to a hydraulic cylinder 87, with the roller die 85 being held at the end of the intermediate member 82. Depending upon the specifications, the intermediate member 82 may be provided with a cam groove 83 and an adjusting lever 84 for adjusting and fixing the angle of the roller die 85 with respect to the axis of the cylindrical pipe P, however, detailed explanation is omitted.

Here is a description of the function of the pipe manufacturing device 40.

In operation, the main feeding section 50 feeds a thin-wall blank cylindrical pipe in the direction of the axis of the pipe at a prescribed pitch, while rotating it at a definite speed; the roller die 85 is pressed against the outer periphery of the cylindrical pipe P; and the roller die 85 is advanced and retracted in accordance with the feed of the cylindrical pipe P in order to form a spiral corrugation which groove depth is gradually increased, starting from the flat portion of the cylindrical pipe P, and reaches a maximum in the portion opposed to the flat one.

In the main feeding section 50, the main feeding shaft 55 is advanced leftward in FIG. 1 to chuck the rear end of the cylindrical pipe P with the chuck 51; and the front end of the cylindrical pipe P is inserted into the bearing 75 in the working section 70 where the bolts 79, 79 are loosened. Tightening the bolts 79, 79 will force the bearing 75 in to fit it to the outside diameter of the cylindrical pipe P to hold it without clearance.

In the power section 41, the drive motor 42 drives the output sprocket 44 as a power source through the speed reducer 43. The sprocket 64 in the power receiving section 63 in the power relaying section 60 receives the driving power from the output sprocket 44 through the chain. By this, the power relaying shaft 62, which is a square shaft, is rotated, being supported by the bearings 62*a*, 62*b*. The power receiving section 63 is rotated together with the rollers 63*a*, 63*a*, . . . , the power relaying shaft 62 being rotated in the state in which it can be slid in the axial direction.

Through the sprockets 57, 68 which are provided in the end portions of the main feeding shaft 55 and the power relaying shaft 62, respectively, being connected to each other by the chain, the power is transmitted, and the main feeding shaft 55 in the main feeding section 50 is rotated.

When the main feeding shaft 55 is rotated, it is advanced or retracted in the axial direction with respect to the nut member 56, and being connected by the connecting member 67, the main feeding shaft 55 in the main feeding section 50 and the power relaying shaft 62 in the power relaying section 60 can be advanced or retracted, and rotated in synchronization. In working, they are retracted from the advanced position.

In the working section 70, the roller die 85 faces the outer periphery of the cylindrical pipe P through the insertion opening 73*a* provided in the housing 73, and the roller feeding section 80 advances and retracts the roller die 85 in accordance with the feed of the cylindrical pipe P.

The roller die 85 is advanced and retracted in accordance with the feed of the cylindrical pipe P, which consecutively forms a spiral corrugation which groove depth is gradually increased, starting from the flat portion of the cylindrical pipe P, and reaches a maximum in the portion opposed to the flat one.

Depending upon the specifications, the cam groove 83 may be displaced by means of the adjusting lever 84 for adjusting and fixing the angle of the roller die 85 with respect to the axis of the cylindrical pipe P.

What is claimed is:

1. A pipe manufacturing method, wherein a thin-wall blank cylindrical pipe is fed in increments of a prescribed distance, while being rotated at a definite speed, a roller die being pressed against the outer periphery of the cylindrical pipe, the roller die being advanced and retracted in accordance with the feed of the cylindrical pipe, for forming a spiral corrugation such that a groove depth thereof is gradually increased, starting from a flat portion of the cylindrical pipe, and reaches a maximum in a portion opposed to the flat one.

2. A pipe manufacturing device, comprising a working section which allows rotatably and slidably inserting a thin-wall blank cylindrical pipe which is to be fed in the direction of the axis of the pipe in increments of a prescribed distance, while being rotated at a definite speed; and a roller feeding section in which a roller die is supported so as to face the outer periphery of the cylindrical pipe through an insertion opening provided in the working section, and the roller die is advanced and retracted in accordance with the feed of the cylindrical pipe, for forming a spiral corrugation such that a groove depth thereof is gradually increased, starting from a portion of the cylindrical pipe, and reaches a maximum in a portion opposed to the flat one.

3. The pipe manufacturing device according to claim 2, wherein said working section has a housing and a bearing incorporated in the housing, said bearing being made of a self-lubricating material, having a slide way therein to rotatably hold the cylindrical pipe, and a tapered outer periphery, being held in the housing such that the bearing is capable of being moved in the direction of the axis of the cylindrical pipe for adjustment, and allowing the cylindrical pipe to be held with no clearance by moving the bearing for adjustment and fixing it.

* * * * *